US006746284B1

(12) United States Patent
Spink, Jr.

(10) Patent No.: US 6,746,284 B1
(45) Date of Patent: Jun. 8, 2004

(54) ELECTRICAL CONNECTOR ASSEMBLY HAVING SIGNAL AND POWER TERMINALS

(75) Inventor: William E. Spink, Jr., Laguna Niguel, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/678,988

(22) Filed: Oct. 2, 2003

(51) Int. Cl.[7] ..... H01R 13/42

(52) U.S. Cl. ..... 439/740; 439/651; 439/680; 439/733.1

(58) Field of Search ..... 439/740, 733.1, 439/354, 353, 357, 638, 651, 680

(56) References Cited

U.S. PATENT DOCUMENTS 4,304,457 A * 12/1981 Lissau ..... 439/851
5,316,503 A * 5/1994 Thompson et al. ..... 439/740
5,366,391 A * 11/1994 Deiss ..... 439/740
5,421,748 A * 6/1995 Mouissie ..... 439/740
5,899,773 A * 5/1999 Cheng ..... 439/659
6,338,657 B1 * 1/2002 Harper et al. ..... 439/692
6,379,189 B2 * 4/2002 Sakai et al. ..... 439/651
6,435,916 B1 * 8/2002 Amberg et al. ..... 439/651

* cited by examiner

*Primary Examiner*—Gary Paumen
(74) *Attorney, Agent, or Firm*—Wei Te Chung

(57) ABSTRACT

A cable connector (2) includes a number of signal and power cables (26, 28), a dielectric housing (20) defining a number of passageways (204), a number of signal contacts (22) received in the housing and electrically connecting with the signal cables, and a number of power contacts (24) received in the passageways. Each passageway has a guiding channel (2041) and a receiving space (2043). Each power contact includes a contact portion (242) for mating with a complementary contact, a tail portion (244) electrically connecting with a corresponding power cable and a middle portion (240) connected between the contact portion and the tail portion. The contact portion has a projection (246) formed adjacent the middle portion. Each power contact is assembled to a corresponding passageway by moving the projection into the guiding channel and then rotating the projection into the receiving space.

4 Claims, 10 Drawing Sheets

ELECTRICAL CONNECTOR ASSEMBLY HAVING SIGNAL AND POWER TERMINALS

BACKGROUND OF THE INVENTION

1. Field of the Invention

The present invention relates to an electrical connector assembly, and particularly to an electrical connector assembly having signal and power terminals for high current carrying requirements.

2. Description of Related Art

Electrical connector assemblies are widely used in many electronic systems for performing signal and power transmission. An electrical connector assembly generally comprises a header mounted on a printed circuit board of the electronic system and a cable connector mating with the header. The header and the cable connector each comprise a dielectric housing and a plurality of signal and power contacts retained in the housing for signal and power transmission.

With high current carrying requirements of certain electronic systems, such as an electric weed eater power tool, the electrical connector assembly must accordingly be capable of carrying high current to thereby distribute signal and power from a motor to a printed circuit board of the electric weed eater power tool. On the other hand, the electrical connector assembly should be properly designed to have a configuration that not only meets the trend of the miniaturization of the electronic systems but also ensures a correct and a reliable engagement between the header and the cable connector.

Hence, the present invention aims to provide an improved electrical connector assembly having signal and power terminals to meet the above-mentioned requirements.

SUMMARY OF THE INVENTION

Accordingly, it is an object of the present invention to provide an electrical connector assembly having signal and power terminals for high current carrying requirements.

It is still an object of the present invention to provide an electrical connector assembly being of a simplified configuration and having a correct and a reliable engagement between matable connectors thereof.

It is still another object of the present invention to provide an electrical connector having improved contacts easily assembled into and securely received in corresponding passageways of a dielectric housing thereof.

In order to achieve the objects set forth, an electrical connector assembly in accordance with the present invention comprises a cable connector and a complementary header. The cable connector comprises a first dielectric housing defining a receiving cavity in a mating surface thereof and forming a signal block in the receiving cavity, a plurality of first signal contacts and first power contacts retained in the first housing, and a plurality of signal and power cables electrically connecting with the first signal contacts and the first power contacts, respectively. Each first signal contact comprises a first mating portion received in the signal block. Each first power contact comprises a first contact portion extend into the receiving cavity. The header is received in the receiving cavity of the cable connector and comprises a second dielectric housing defining a chamber in a mating surface thereof with the signal block received therein, and a plurality of second signal and power contacts received in the second housing. Each second signal contact comprises a second mating portion extending into the chamber and engaging with the first mating portion of a corresponding first signal contact. Each second power contact comprises a second contact portion engaging with the first contact portion of a corresponding first power contact.

According to one aspect of the present invention, the first dielectric housing defines a plurality of passageways each comprising a guiding channel and a receiving space. Each first power contact is machined from conductive material and forms a projection on the first contact portion thereof. Each first power contact is assembled to a corresponding passageway by moving the projection into the guiding channel and then rotating the projection into the receiving space.

Still according to another aspect of the present invention, the first housing defines an alignment slot communicating with the receiving cavity and the second housing has an alignment key received in the alignment slot. The first housing defines a matching slot communicating with the receiving cavity and has a latching portion beside the latching slot. The second housing has a retention latch received in the latching slot and latching with the latching portion.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
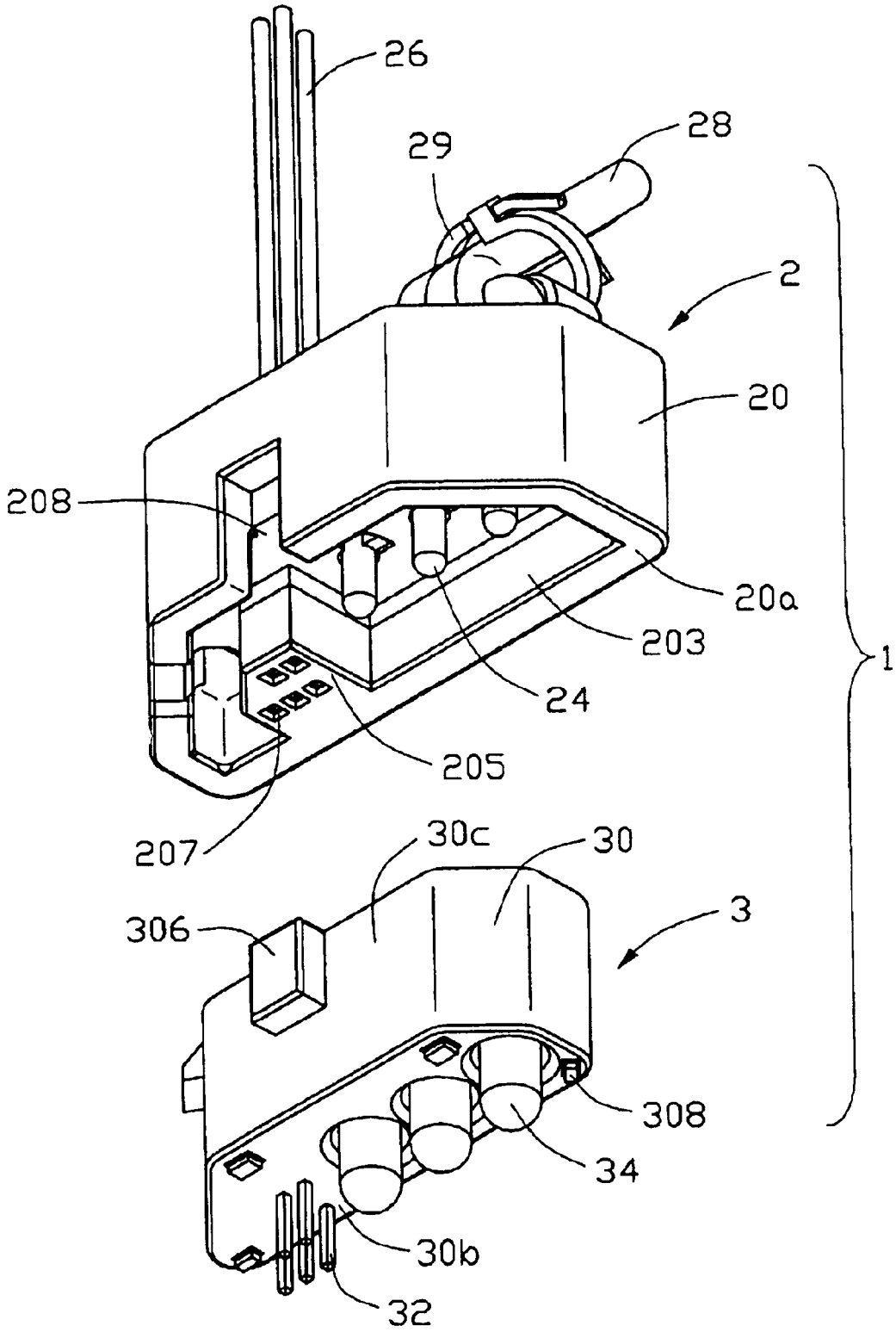
FIG. 1 is a perspective view of an electrical connector assembly in accordance with the present invention and comprising a header and a cable connector disconnected with each other.
Figure 2:
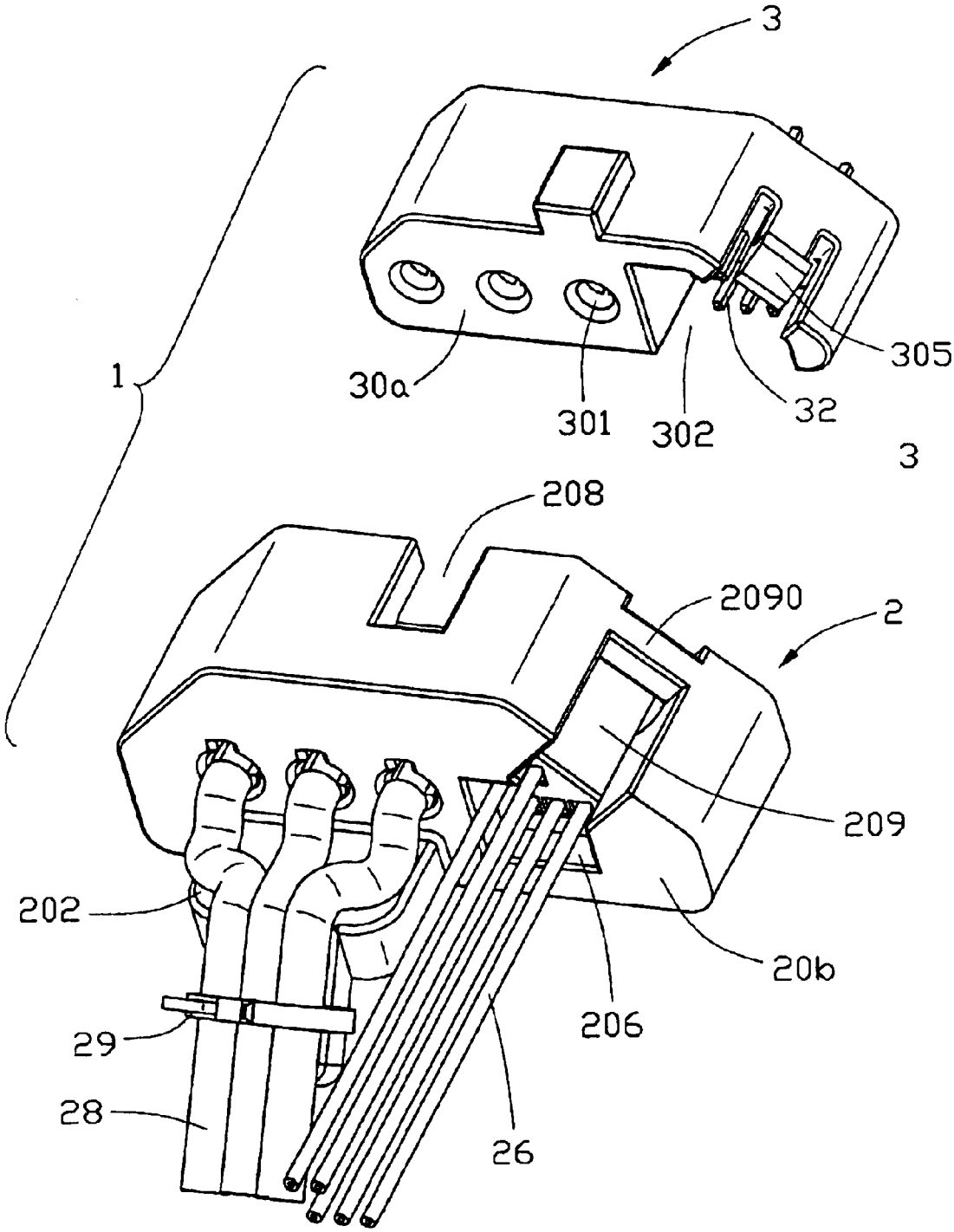
FIG. 2 is a view similar to FIG. 1, but taken from a different aspect.

Referring to FIGS. 1 and 2, an electrical connector assembly 1 in accordance with the present invention comprises a cable connector 2 and a complementary header 3 for being used in electronic systems having high current carrying requirements.

Figure 4:
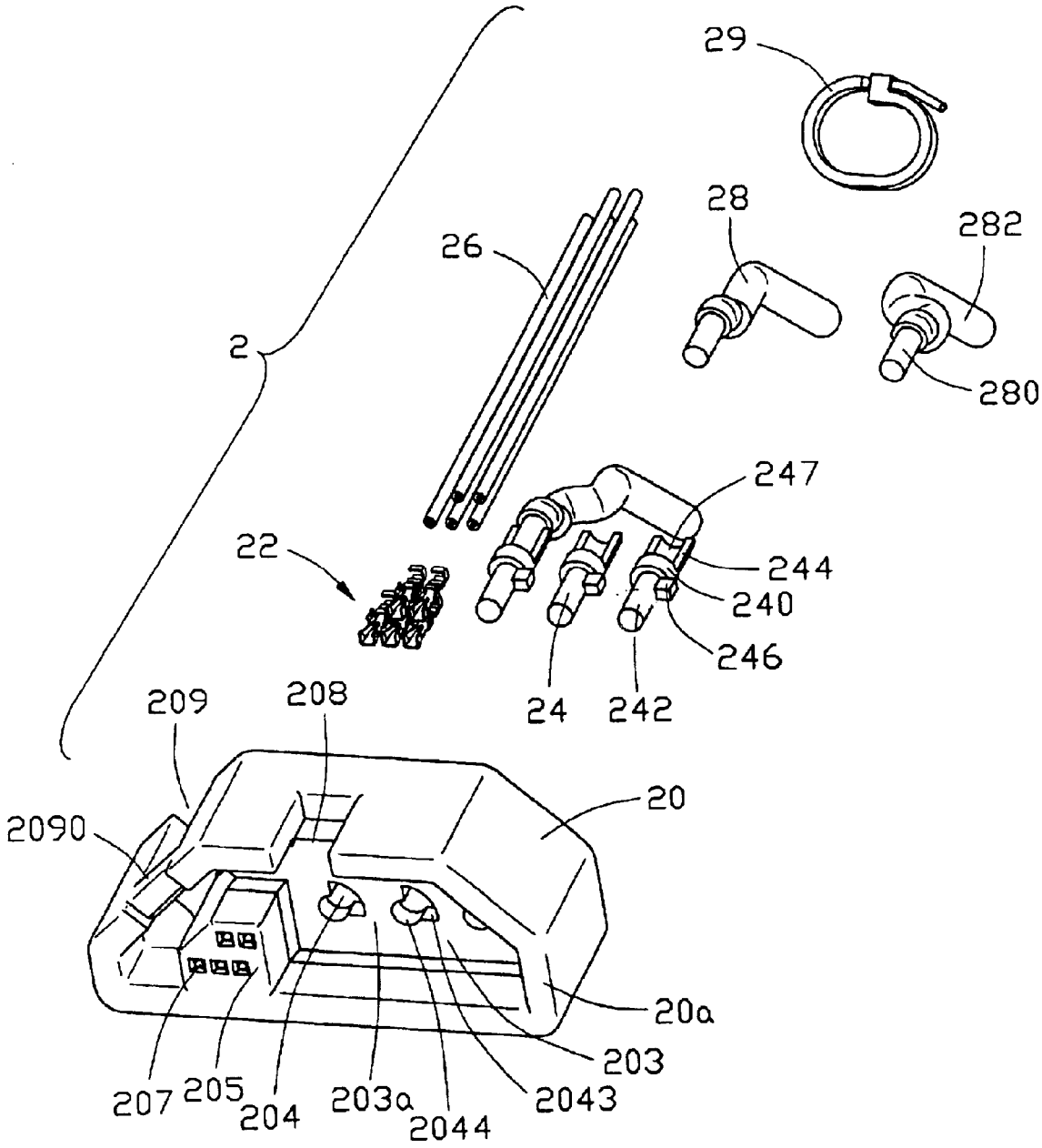
FIG. 4 is an exploded perspective view of the cable connector.
Figure 5:
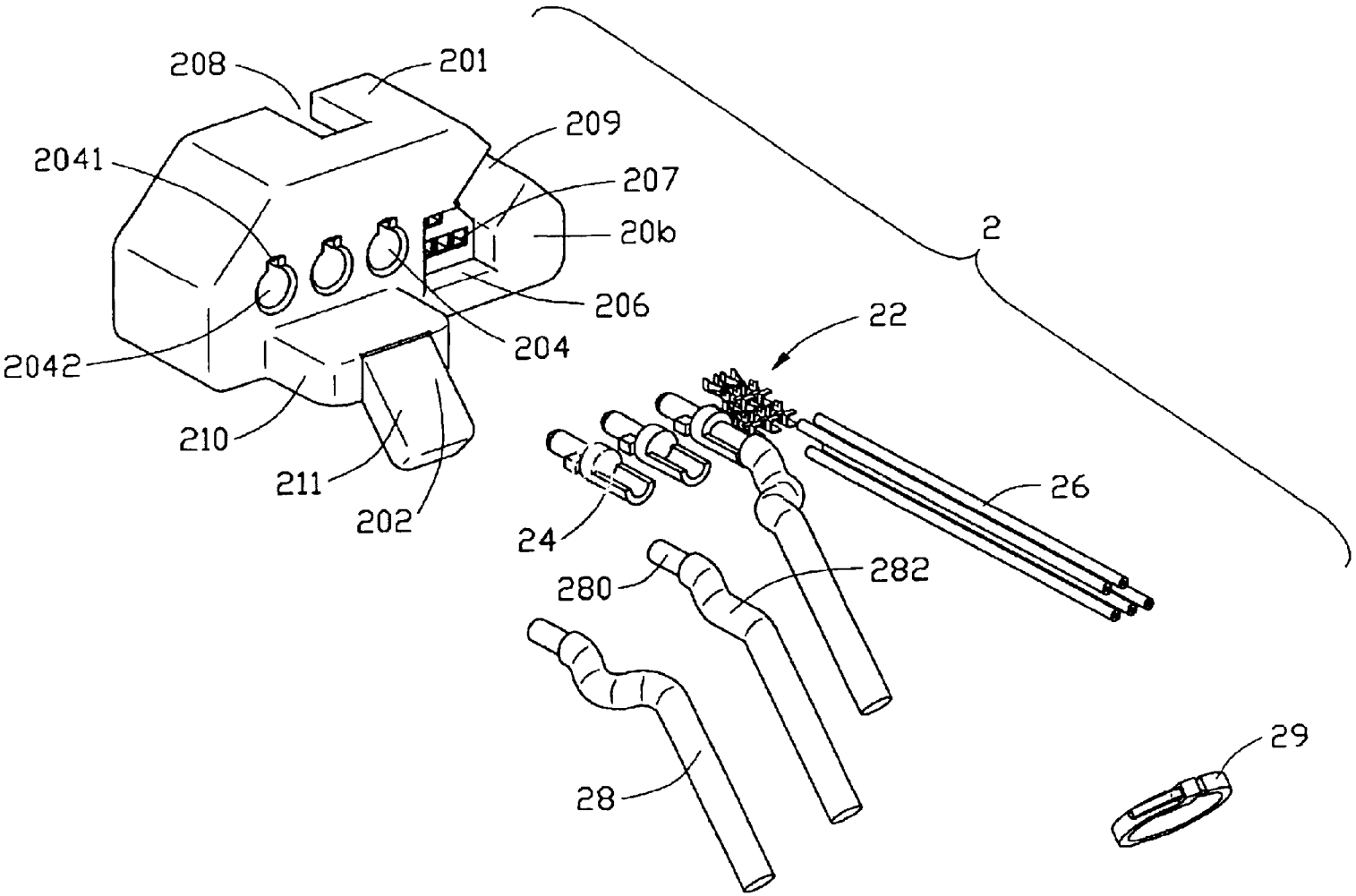
FIG. 5 is a view similar to FIG. 4, but taken from a different aspect.
Figure 6:
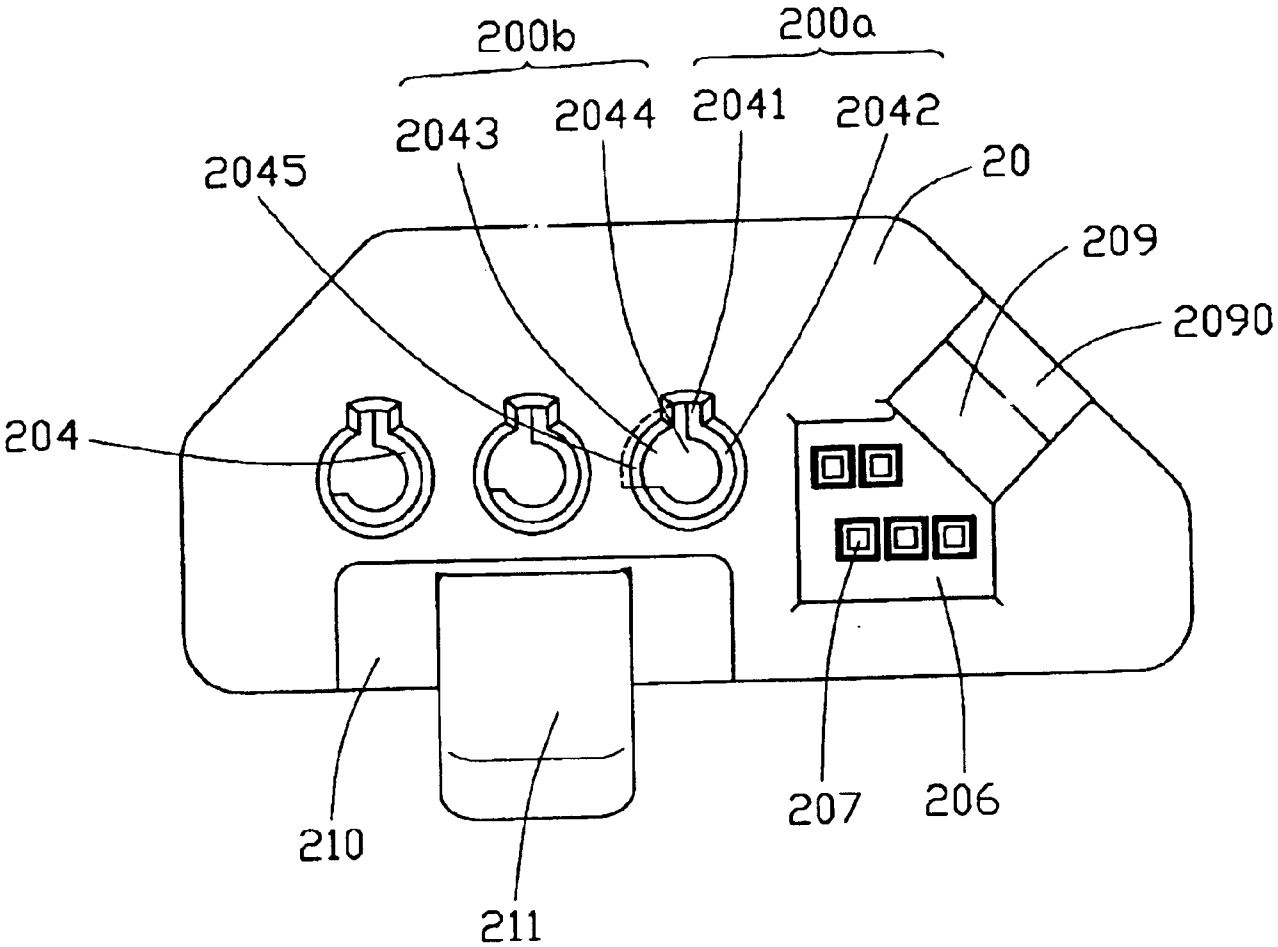
FIG. 6 is a rear plan view of an insulating housing of the cable connector shown in FIG. 5.

Referring to FIGS. 4–6 in conjunction with FIGS. 1 and 2, the cable connector 2 comprises a first dielectric housing 20, a plurality of first signal contacts 22 and power contacts 24 retained in the first dielectric housing 20, a corresponding number of signal cables, 26 and power cables 28 electrically connecting with the first signal contacts 22 and the first power contacts 24, respectively, and a strain relief 29 bonding the power cables 28 together to resist force exerted on the power cables 28.

The first dielectric housing 20 comprises a main body 201 generally of a tabular and hexahedral configuration and a support 202 extending from the main body 201. The main body 201 has a mating surface 20*a* and an opposite connecting surface 20*b* through which the signal and the power cables 26, 28 extend. The main body 201 defines a receiving cavity 203 in the mating surface 20*a* thereof, and a plurality of passageways 204 extending through the connecting surface 20*b* thereof and an inner surface 203*a* of the receiving cavity 203. The first passageway 204 includes first and second sections 200*a*, 200*b* having different shape. The first section 200*a* is consisted of a guiding channel 2041 and a large-dimensioned cylindrical slot 2042. The second section 200*b* is adjacent to the inner surface 203*a* of the receiving cavity 203 and is consisted of a receiving space 2043 and a small-dimensioned cylindrical slot 2044. The main body 201 is formed with a signal block 205 beside the passageways 204 in the receiving cavity 203 and defines a depression 206 in the connecting surface 20*b* corresponding to the signal block 205. The signal block 205 defines a plurality of slots 207 communicating with the depression 206. The main body 201 further defines an alignment slot 208 and a latching slot 209, both of which communicate with the receiving cavity 203. The main body 201 is formed with a latching portion 2090 beside the latching slot 209.

The support 202 includes a horizontal connecting portion 210 connecting with a lower portion of the connecting surface 20*b* and an exit 211 extending downwardly and rearwardly from the connecting portion 210. In a preferred embodiment, the exit 211 is formed at an angle of 45 degrees with respect to the horizontal connecting portion 210.

Figure 7:
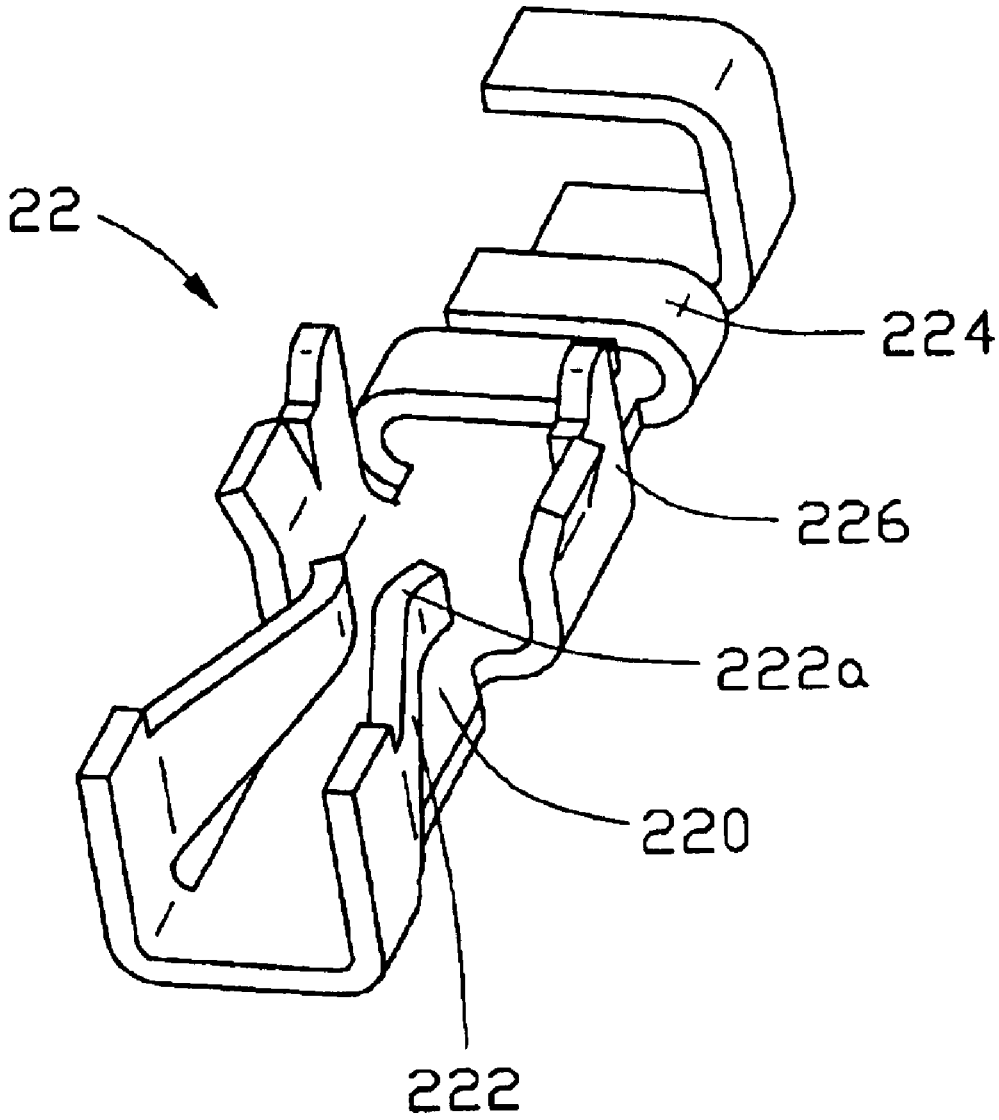
FIG. 7 is an enlarged perspective view of a signal contact of the cable connector.

Referring to FIG. 7 in conjunction with FIGS. 1 and 2, each first signal contact 22 is stamped from a metal sheet and includes an elongate plate 220, a pair of resilient arms 222 extending upwardly and rearwardly from opposite sides adjacent a first end of the elongate plate 220, several spring fingers 224 located adjacent a second end of the elongate plate 220 and extending from one side of the elongate plate 220 toward an opposite side of the elongate plate 220, and a pair of retention wings 226 extending upwardly from the opposite sides of the elongate plate 220 between the resilient arms 222 and the spring fingers 224.

The spring fingers 224 of each first signal contact 22 electrically connect with a corresponding signal cable 26. The first signal contacts 22 together with the signal cables 26 are assembled into the slots 207 of the first housing 20 from the connecting surface 20*b*. The resilient arms 222 of each first signal contact 22 are positioned adjacent to the mating surface 20*a* of the first housing 20 with a pair of contacting portions 222*a* projecting toward each other. The retention wings 226 have an interferential engagement with the first housing 20 in the corresponding slots 207 to thereby fix the first signal contacts 22 in the first housing 20.

Referring back to FIGS. 4 and 5, each first power contact 24 is screw machined from conductive material and includes an annular middle portion 240, a cylindrical contact portion 242 extending forwardly from a front face of the middle portion 240 and a solder portion 244 extending rearwardly from a rear face of the middle portion 240. The cylindrical contact portion 242 is formed with a projection 246 adjacent the middle portion 240. The solder portion 244 defines a semi-cylindrical recess 247.

Each power cable 28 includes a conductor 280 and a jacket 282 enclosing the conductor 280. The conductor 280 is exposed out of the jacket 282 at one end of the power cable 28 to be placed in the semi-cylindrical recess 247 and soldered with the solder portion 244 of a corresponding power contact 24. The first power contacts 24 together with the power cables 28 are assembled into the passageways 204 of the first housing 20 from the connecting surface 20*b*. Once the projection 246 of each first power contact 24 is aligned with the guiding channel 2041 of a corresponding passageway 204, the first power contact 24 moves forwardly along the large-dimensioned cylindrical slot 2042 until the middle portion 240 abuts against a transition insulating portion 2045 between the first and the second sections 200*a*, 200*b* of the first passageway 204, and then rotates in a counterclockwise direction until the projection 246 is received in the receiving space 2043. The middle portion 240 and the projection 246 of the first power contact 24 forwardly and rearwardly abut against the transition insulating portion 2045, respectively, for resisting the first power contact 24 from moving forwardly and rearwardly. There exists a gap 204*c* (FIG. 10) between the passageway 204 and the first power contact 24 to allow airflow therethrough for cooling of the first power contact 24.

Referring back to FIG. 2, the signal cables 26 and the power cables 28 extend rearwardly beyond the connecting surface 20*b* of the first housing 20. The power cables 28 are supported by the horizontal connecting portion 210 and the exit 211. The exit 211 can also function as a pull tab to facilitate disengaging the cable connector 2 from the header 3. The strain relief 29 is attached to the exit 211 to bond the power cables 28 together not only for resisting force exerted on the power cables 28 but also for preventing the first power contacts 24 from rotating. It is noted that the signal cables 26 can also dress through the strain relief 29.

Figure 8:
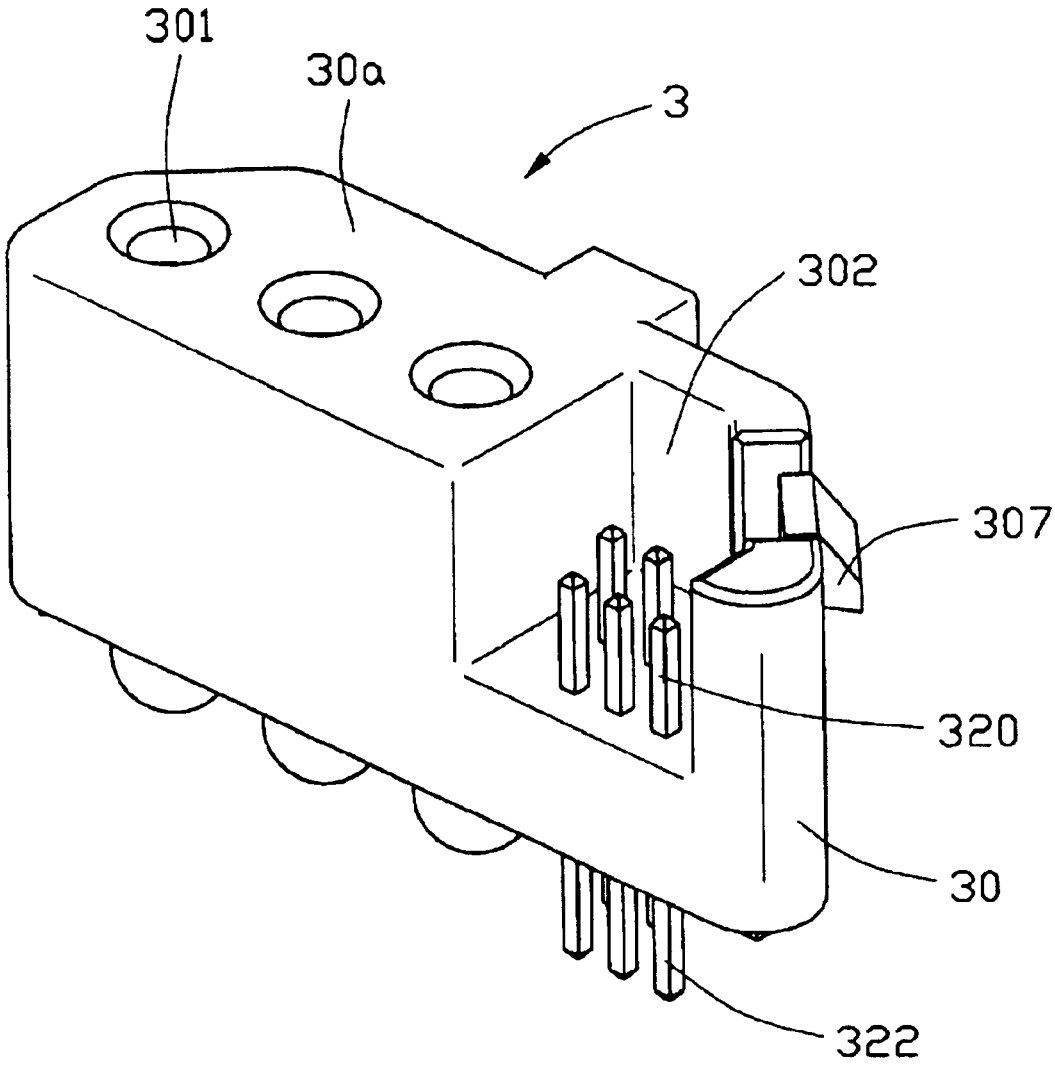
FIG. 8 is a perspective view of the header taken from an aspect different from that shown in FIGS. 1 and 2.
Figure 9:
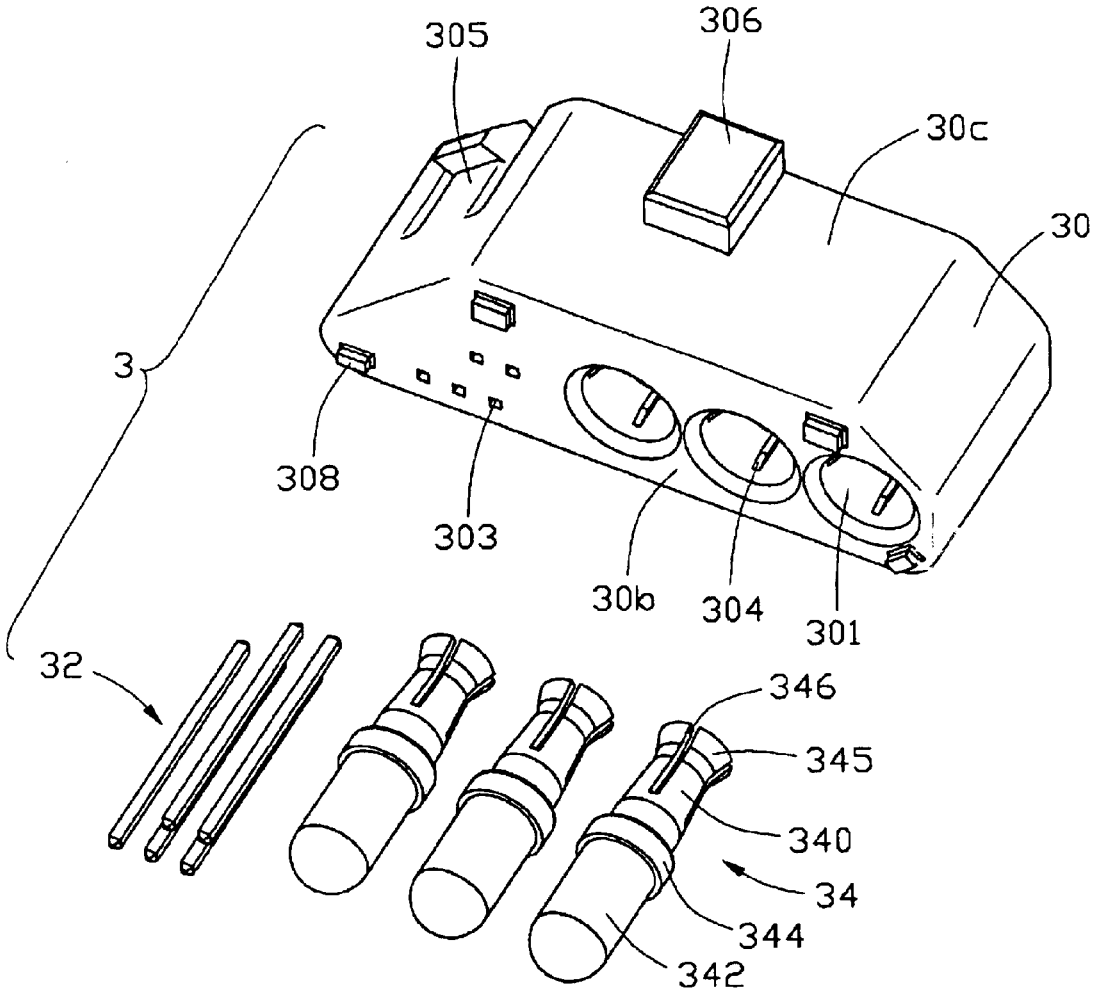
FIG. 9 is an exploded perspective view of the header.
Figure 10:
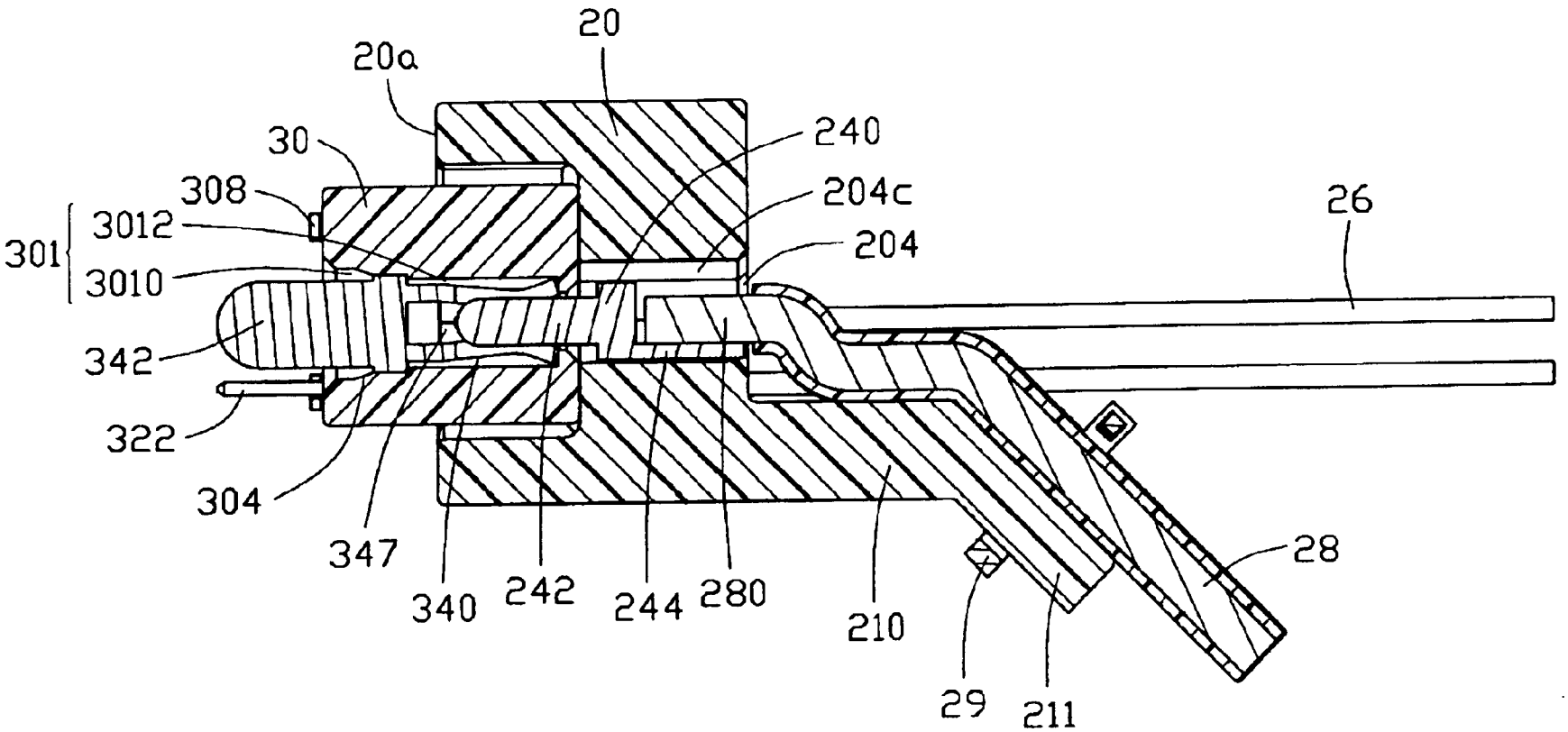
FIG. 10 is a cross-sectional view taken along line 10—10 of FIG. 3.

Referring to FIGS. 8, 9 and 10, the header 3 comprises a second dielectric housing 30, and a plurality of second signal contacts 32 and power contacts 34 retained in the second dielectric housing 30. The second housing 30 has a hexahedral configuration substantially the same as the shape of the receiving cavity 203 of the cable connector 2. The second housing 30 has a mating surface 30*a* facing the cable connector 2 and a mounting surface 30*b* opposite to the mating surface 30*a*. The second housing 30 defines a plurality of apertures 301 extending through the mating surface 30*a* and the mounting surface 30*b*, a chamber 302 in the mating surface 30*a* beside the apertures 301 and a plurality of through holes 303 communicating with the chamber 302. Each aperture 301 includes a first large-dimensioned section 3010 and a second small-dimensioned section 3012. A plurality of ribs 304 is formed on inner circumferential faces of each first large-dimensioned section 3010. The second housing 30 is formed with a retention latch 305 beside the chamber 302 and an alignment key 306 on a top surface 30*c* thereof. The retention latch 305 has a hook 307 at a free end thereof. A plurality of standoffs 308 is formed on the mounting surface 30*b* of the second housing 30 to allow the header 3 having a predetermined distance spaced from a printed circuit board (not shown) on which the header 3 is mounted.

The second signal contacts 32 are stamped from a metal sheet and are received in corresponding through holes 303, respectively. Each second signal contact 32 includes a mating portion 320 projecting into the chamber 302, a retention portion (not labeled) retained in a corresponding through hole 303 and a mounting portion 322 extending beyond the mounting surface 30*b* for electrically connecting to the printed circuit board.

The second power contacts 34 are screw machined from conductive material and are assembled into corresponding apertures 301, respectively. Each second power contact 34 includes an engaging portion 340 received in the second small-dimensioned section 3012 of the aperture 301, a cylindrical tail portion 342 projecting beyond the mounting surface 30*b* for electrically connecting to the printed circuit board, and an intermediate portion 344 connected between the engaging portion 340 and the tail portion 342. The engaging portion 340 is a hollow cylindrical post and has several elastic arms 345. Every two adjacent elastic arms 345 form a slit 346 therebetween. The ribs 304 in each aperture 301 tightly press against outer circumferential faces of the intermediate portion 344 of a corresponding second power contact 34 to retain the second power contact 34 in the second housing 30. The engaging portion 340 has an inner contacting section 347 for contacting with the contacting portion 242 of the first power contact 24 of the cable connector 2.

Figure 3:
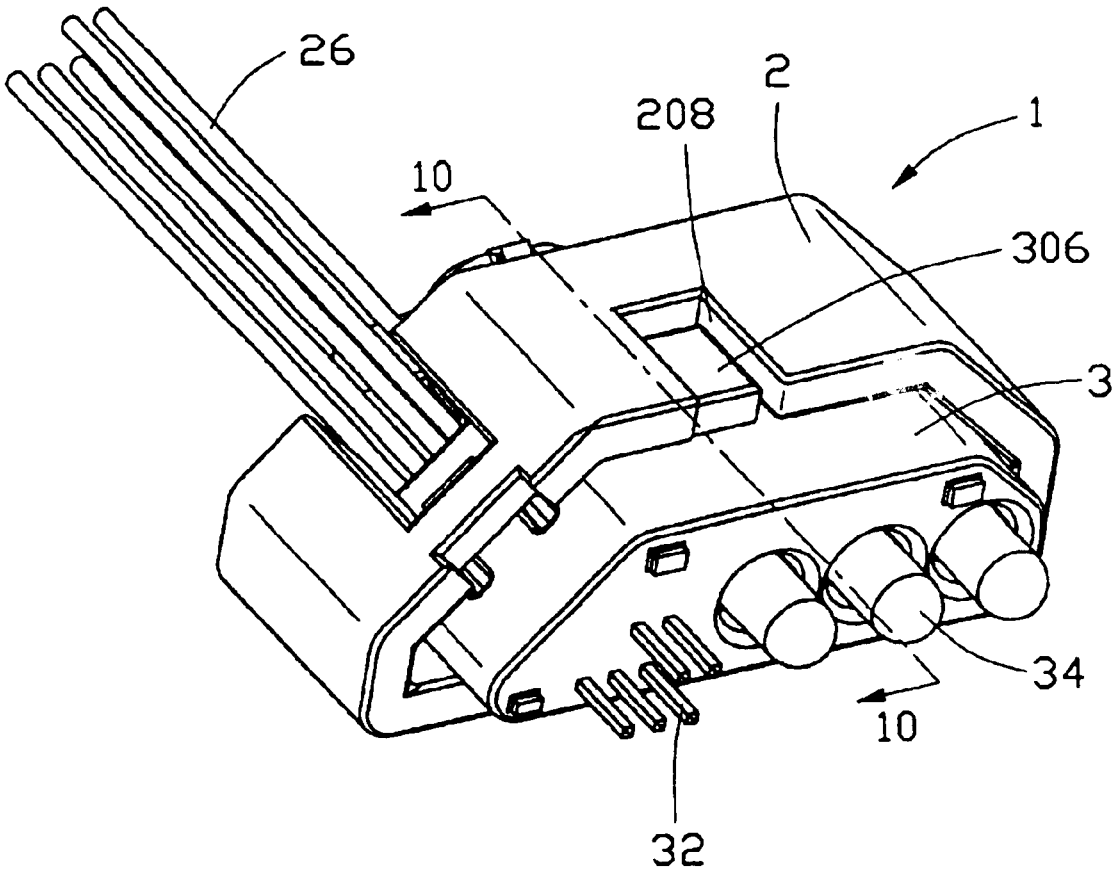
FIG. 3 is an assembled perspective view of the header and the cable connector shown in FIG. 1.

Referring to FIGS. 3 and 10, the cable connector 2 and the header 3 are in a mated condition. The alignment key 306 is received in the alignment slot 208 to ensure a correct engagement between the cable connector 2 and the header 3. The header 3 is partially received in the receiving cavity 203 of the cable connector 2 and the signal block 205 of the cable connector 2 is accommodated in the chamber 302 of the header 3. The cylindrical contact portions 242 of the first power contacts 24 extend into hollow engaging portions 340 of the second power contacts 34 to electrically contact with the inner contacting sections 347 of the engaging portions 340. The mating portions 320 of the second signal contacts 32 extend into the slots 207 of the cable connector 2 to contact with the contacting portions 222*a* of the resilient arms 222 of the first signal contacts 22. The retention latch 305 of the header 3 is received in the latching slot 209 of the cable connector 2 with the hook 307 thereof latching with the latching portion 2090 to ensure a reliable electrical and mechanical connection between the cable connector 2 and the header 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

a plurality of signal and power cables;

a dielectric housing defining a plurality of slots and passageways, each passageway comprising a guiding channel and a receiving space;

a plurality of signal contacts received in the slots and electrically connecting with the signal cables; and a plurality of power contacts each comprising a contact portion for mating with a complementary contact, a tail portion electrically connecting with a corresponding power cable and a middle portion connected between the contact portion and the tail portion, the contact portion having a projection formed adjacent the middle portion, each power contact being assembled to a corresponding passageway by moving the projection into the guiding channel and then rotating the projection into the receiving space;

wherein the housing defines a receiving cavity in a mating surface thereof receiving the contact portions of the power contacts;

wherein the passageway and a corresponding power contact together define a gap therebetween, the gap extending through an inner surface of the receiving cavity and a connecting surface of the housing which is opposi8te to the mating surface to allow airflow therethrough;

wherein the passageway includes a first and a second section respectively with the guiding channel and the receiving space defined therein, and wherein the housing has a transition portion between the first and the second sections, the middle portion and the projection forwardly and rearwardly abutting against the transition portion, respectively;

wherein the housing comprises a support extending rearwardly from a connecting surface thereof, and wherein the power cables extend rearwardly beyond the connecting surface to be positioned on the support;

wherein the support comprises a connecting portion extending perpendicularly to the connecting surface and an exit extending downwardly and rearwardly from the connecting portion;

further comprising a strain relief attached to the exit and bonding the power cables together;

wherein the tail portion of the power contact defines a semi-cylindrical recess, and wherein the power cable comprises an exposed conductor received in the semi-cylindrical recess;

wherein each signal contact is stamped from a metal sheet and comprises an elongate plate, a pair of resilient arms extending upwardly and rearwardly from opposite sides adjacent a first end of the elongate plate for mating with the complementary contact, and a pair of retention wings extending upwardly from the opposite sides of the elongate plate and interferentially fixed in a corresponding slot.

2. An electrical connector comprising:

a dielectric housing defining a plurality of through slots and apertures, the housing being formed with a plurality of ribs in the aperture;

a plurality of signal contacts received in the through slots; and a plurality of power contacts received in the apertures, each power contact comprising an engaging portion for engaging with a complementary contact, a tail portion projecting beyond a mounting surface of the housing for electrically connecting to a printed circuit board and an intermediate portion connecting the engaging portion with the tail portion, the ribs tightly pressing against the intermediate portion to retain the power contact in the aperture;

wherein the engaging portion is a hollow cylindrical post and comprises a plurality of elastic arms;

wherein the aperture includes a first large-dimensioned section and a second small-dimensioned section, the ribs being formed on inner circumferential faces of the first large-dimensioned section;

wherein the engaging portion comprises a plurality of elastic arms received in the second small-dimensioned section.

3. An electrical connector assembly comprising:

a cable connector comprising:

a first dielectric housing defining a receiving cavity in a mating surface thereof and forming a signal block in the receiving cavity;

a plurality of first signal contacts and first power contacts retained in the first housing, each first signal contact comprising a first mating portion received in the signal block, each first power contact comprising a first contact portion extend into the receiving cavity; and a plurality of signal and power cables electrically connecting with the first signal contacts and the first power contacts, respectively; and an electrical connector received in the receiving cavity of the cable connector, comprising:

a second dielectric housing defining a chamber in a mating surface thereof with the signal block received therein;

a plurality of second signal contacts received in the second housing and each comprising a second mating portion extending into the chamber and engaging with the first mating portion of a corresponding first signal contact; and a plurality of second power contacts received in the second housing and each comprising a second contact portion engaging with the first contact portion of a corresponding first power contact;

wherein the first and the second housings are generally of a hexahedral configuration;

wherein the first housing defines an alignment slot communicating with the receiving cavity, and wherein the second housing has an alignment key received in the alignment slot;

wherein the first housing defines a latching slot communicating with the receiving cavity and has a latching portion beside the latching slot, and wherein the second housing has a retention latch received in the latching slot and latching with the latching portion;

wherein the second mating portion of the second signal contact is a hollow cylindrical post with the first mating portion of the first signal contact received therein.

4. An electrical connector assembly comprising:

an insulative housing including:

a small signal contact area close to a middle portion and a large power contact area by one side of said signal contact area;

an alignment slot formed in a periphery wall of the housing and close to said signal contact area;

a latch slot formed in the periphery wall of the housing and located by the other side of the signal contact area; and a receiving cavity formed in a mating face of the housing except in the signal contact area; wherein said receiving cavity communicates with both said alignment slot and said latch slot;

further including another insulative housing assembled to the mating face and defining another power contact area and another signal contact area respectively coupled to the power contact area and the signal contact area, and further defining a deflectable latch and an undeflectable key respectively coupled to the latch slot and the alignment slot, wherein only said another signal contact area is provide with a chamber for receivably engaging said signal contact area under a condition that said chamber communicates with said latch.

* * * * *